US009918506B2

(12) United States Patent
Tatum

(10) Patent No.: US 9,918,506 B2
(45) Date of Patent: Mar. 20, 2018

(54) HELMET SAFETY SYSTEM

(71) Applicant: Glenn Tatum, Powhatan, VA (US)

(72) Inventor: Glenn Tatum, Powhatan, VA (US)

( * ) Notice: Subject to any disclaimer, the term of this patent is extended or adjusted under 35 U.S.C. 154(b) by 77 days.

(21) Appl. No.: 15/048,278

(22) Filed: Feb. 19, 2016

(65) Prior Publication Data

US 2017/0238642 A1 Aug. 24, 2017

(51) Int. Cl.

| | |
|---|---|
| ***A42B 3/04*** | (2006.01) |
| ***F21V 21/084*** | (2006.01) |
| ***A42B 3/22*** | (2006.01) |

(52) U.S. Cl.

CPC ..... *A42B 3/044* (2013.01); *A42B 3/22* (2013.01); *F21V 21/084* (2013.01)

(58) Field of Classification Search

CPC .... F21V 21/084; F21V 23/003; F21V 23/004; F21V 23/005; F21V 23/006; F21V 23/023; A42B 3/044; A42B 3/0446; A42B 3/0453; A42B 3/22; A42B 3/221

See application file for complete search history.

(56) References Cited

U.S. PATENT DOCUMENTS

| | | | | |
|---|---|---|---|---|
| 5,327,587 | A * | 7/1994 | Hurwitz | H05B 33/02 2/422 |
| 5,327,588 | A * | 7/1994 | Garneau | A42B 3/044 2/209.13 |
| 5,408,393 | A | 4/1995 | Becker | |
| D374,731 | S | 10/1996 | Anwyl-Davies | |
| 5,570,946 | A * | 11/1996 | Chien | A42B 3/044 362/106 |
| 5,871,271 | A * | 2/1999 | Chien | A42B 3/044 362/103 |
| 5,931,559 | A * | 8/1999 | Pfaeffle | A42B 3/044 362/106 |
| 6,326,454 | B1 | 12/2001 | Shimizu | |
| 6,328,454 | B1 * | 12/2001 | Davis | A42B 3/044 362/105 |
| 7,311,413 | B1 | 12/2007 | Barnes | |
| 7,901,104 | B2 * | 3/2011 | McLean | A42B 3/044 362/105 |
| 8,025,432 | B2 | 9/2011 | Wainright | |
| 8,117,676 | B1 | 2/2012 | Cardosa | |
| 8,350,486 | B2 * | 1/2013 | Bucalo | B60Q 1/2676 315/209 R |
| 8,545,069 | B2 | 10/2013 | McCaslin et al. | |
| 2005/0174753 | A1 | 8/2005 | Cao et al. | |
| 2012/0243210 | A1 | 9/2012 | Brown | |
| 2013/0265745 | A1 | 10/2013 | Fischer | |

* cited by examiner

*Primary Examiner* — Alan Cariaso

(57) ABSTRACT

A helmet safety system for enhancing visibility of a helmet in a hazardous area includes a helmet that may be worn in a hazardous area. A lighting unit is removably coupled to the helmet. The lighting unit may emit light thereby enhancing visibility of the helmet in the hazardous area.

9 Claims, 4 Drawing Sheets

HELMET SAFETY SYSTEM

BACKGROUND OF THE DISCLOSURE

Field of the Disclosure

The disclosure relates to safety devices and more particularly pertains to a new safety device for enhancing visibility of a helmet in a hazardous area.

SUMMARY OF THE DISCLOSURE

An embodiment of the disclosure meets the needs presented above by generally comprising a helmet that may be worn in a hazardous area. A lighting unit is removably coupled to the helmet. The lighting unit may emit light thereby enhancing visibility of the helmet in the hazardous area.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
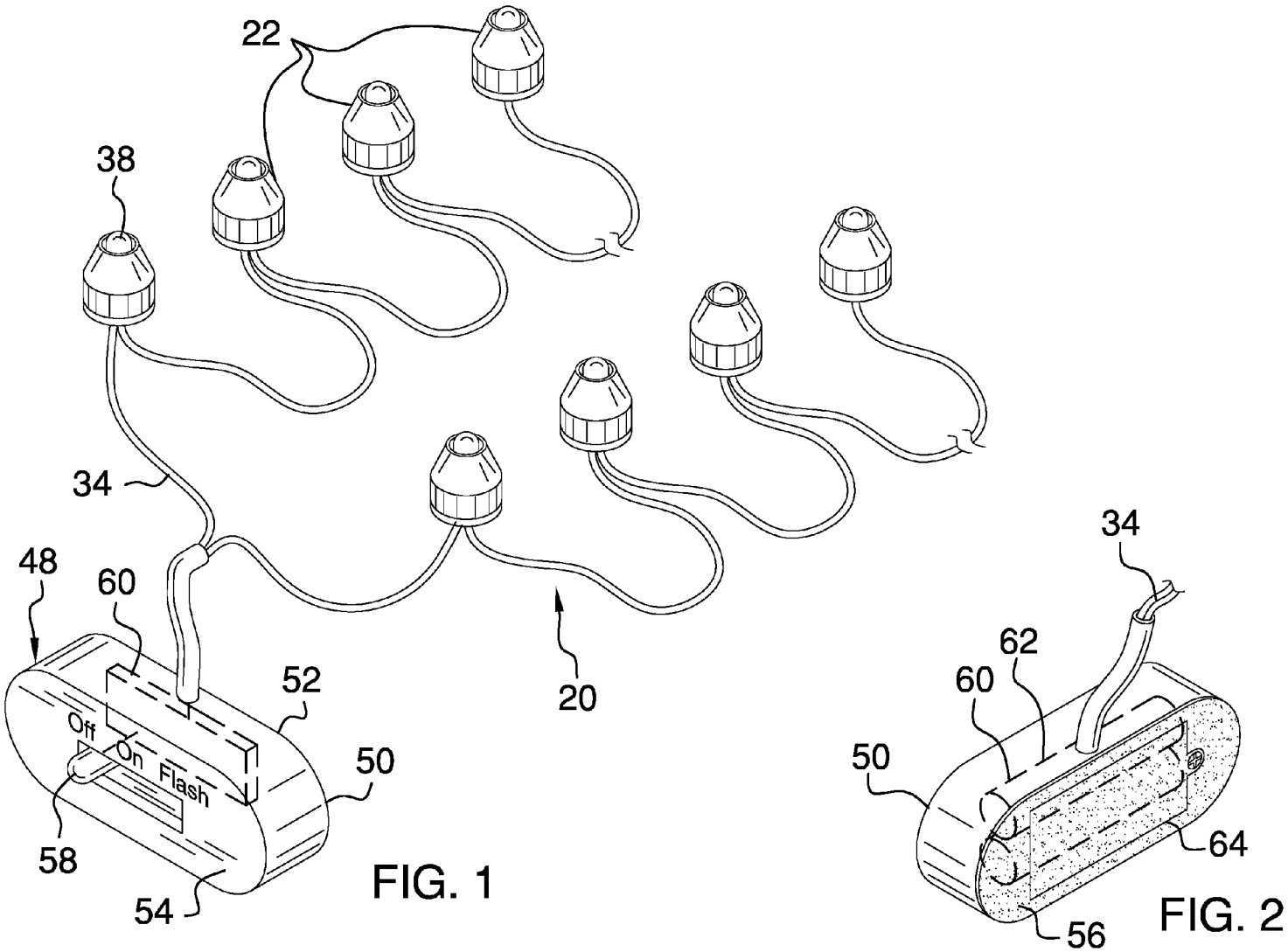
FIG. 1 is a perspective view of a helmet safety system according to an embodiment of the disclosure.
FIG. 2 is a back perspective view of housing of an embodiment of the disclosure.
Figure 3:
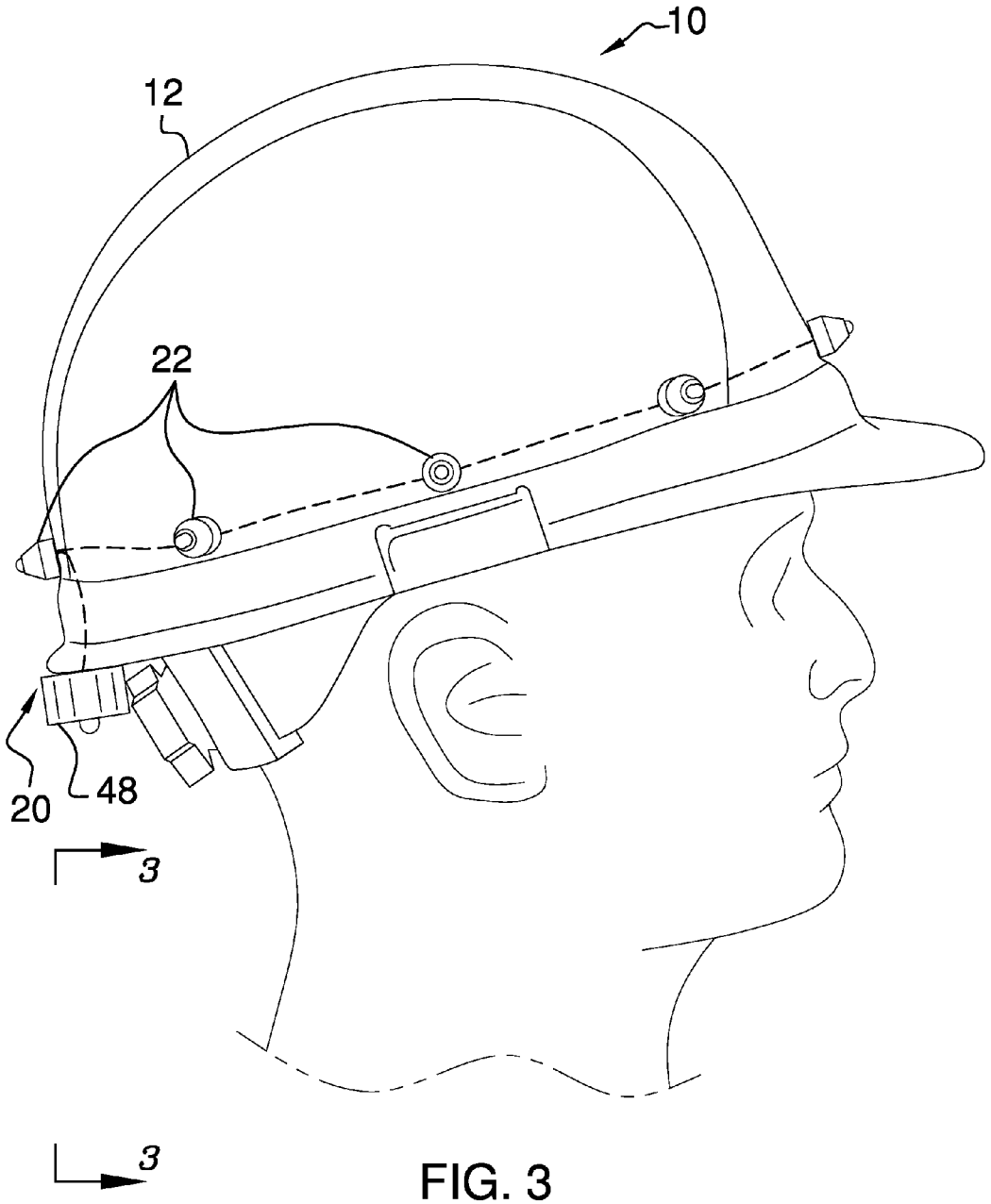
FIG. 3 is a perspective in-use view of an embodiment of the disclosure.
Figure 4:
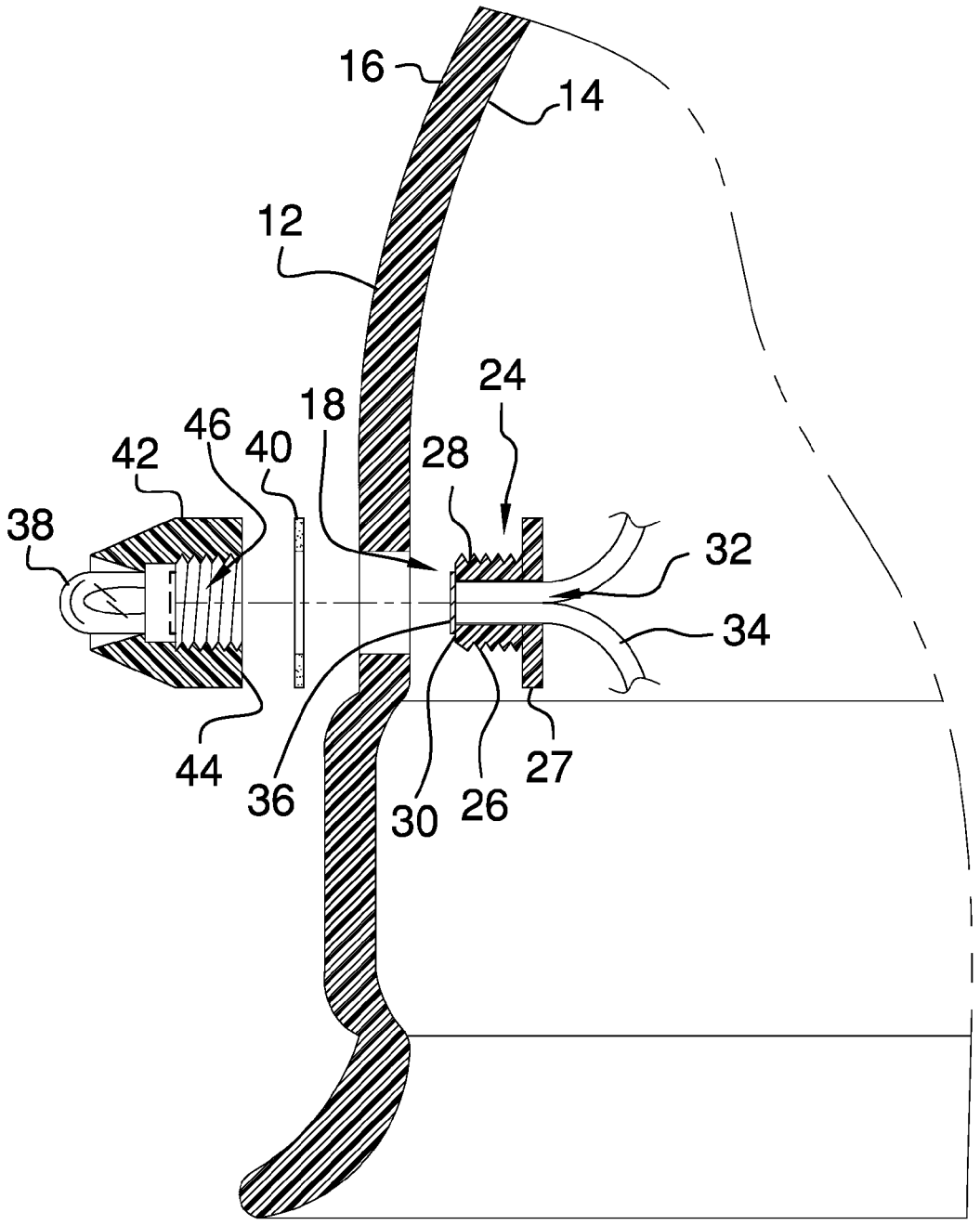
FIG. 4 is a cross sectional view taken along line 4-4 of FIG. 3 of an embodiment of the disclosure.
Figure 5:
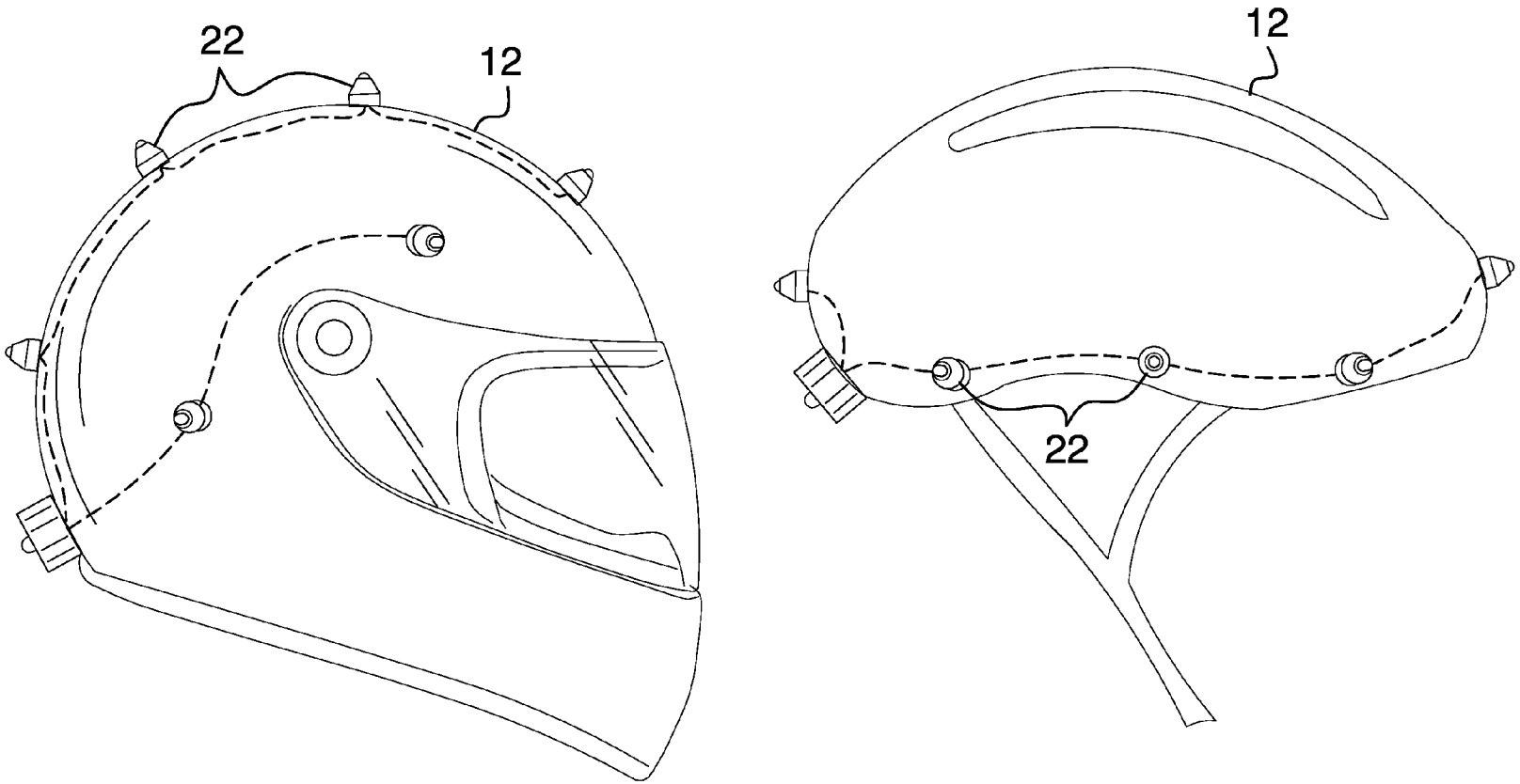
FIG. 5 is a left side perspective view of an embodiment of the disclosure.

With reference now to the drawings, and in particular to FIGS. 1 through 5 thereof, a new safety device embodying the principles and concepts of an embodiment of the disclosure and generally designated by the reference numeral 10 will be described.

As best illustrated in FIGS. 1 through 5, the helmet safety system 10 generally comprises a helmet 12 that may be worn in a hazardous area. The helmet 12 has an inner surface 14 and an outer surface 16. The helmet 12 has a plurality of holes 18 extending through the inner surface 14 and the outer surface 16. The holes 18 are spaced apart from each other and are distributed around the helmet 12. The helmet 12 may comprise a bicycle helmet, a construction helmet, a motorcycle helmet or other helmet worn for head protection.

The hazardous area may be a construction site, a roadway with heavy traffic or other area involving moving equipment or vehicles.

A lighting unit 20 is removably coupled to the helmet 12. The lighting unit 20 emits light thereby enhancing visibility of the helmet 12 in the hazardous area. The lighting unit 20 comprises a plurality of light emitters 22. Each of the light emitters 22 is removably coupled to the helmet 12. The light emitters 22 are electrically coupled to each other to form a circuit.

Each of the light emitters 22 comprises a fastener 24 that has a shaft 26 extending away from a plate 27. The shaft 26 has an outer surface 28 and the outer surface of the shaft 26 is threaded. The shaft 26 has a distal end 30 with respect to the plate 27 and the distal end 30 is open. The plate 27 has an opening 32 extending therethrough and the fastener 24 is substantially hollow. The shaft 26 is inserted through an associated one of the holes 18 in the helmet 12. Thus, the plate 27 abuts the inner surface 14 of the helmet 12.

At least one conductor 34 is provided. The at least one conductor 34 extends through the opening 32 in the plate 27 and the distal end 30 of the shaft 26. The at least one conductor 34 may comprise an insulated wire or the like. A contact 36 is electrically coupled to the at least one conductor 34. The contact 36 abuts the distal end 30 of the shaft 26 such that the contact 36 is exposed.

Each of the light emitters 22 further includes a bulb 38 that threadably engages the shaft 26 when the shaft 26 is extended through the selected hole 18. Thus, each of the bulb 38 and the fastener 24 are removably coupled to the helmet 12. The bulb 38 is electrically coupled to the contact 36 when the bulb 38 threadably engages the shaft 26. The bulb 38 may comprise an LED or the like. A gasket 40 may be provided and the gasket 40 is compressed between the bulb 38 and the outer surface 16 of the helmet 12 when the bulb 40 is coupled to the fastener 24.

The bulb 38 may be positioned within a bulb housing 42. The bulb housing 42 may have a first surface 44 and a well 46 may extend into the first surface 44. The bulb 38 extends into the well 46 and the well 46 may threadably receive the shaft 26. Thus, the contact 36 is electrically coupled to the bulb 38 when the bulb housing 42 is coupled to the fastener 24. The gasket 40 may be compressed between the first surface 44 and the helmet 12.

A control 48 is removably coupled to the helmet 12 and the control 48 may be manipulated. The control 48 turns the lighting unit 20 and on and off. The control 48 comprises a housing 50 that has a back wall 52 and a front wall 54. An adhesive layer 56 is coupled to the back wall 52. The adhesive layer 56 adhesively engages the outer surface 16 of the helmet 12. Thus, the housing 50 is removably coupled to the helmet 12. The at least one conductor 34 extends into the housing 50.

A switch 58 is movably coupled to the front wall 54 and the switch 58 may be manipulated. The switch 58 is electrically coupled to the at least one conductor 34 such that the switch 58 turns the light emitters 22 on and off. The switch 58 may have an off position, an on position and a flash position. The light emitters 22 may emit constant light when the switch 58 is manipulated into the on position. The light emitters 22 may flash alternately on and off when the switch 58 is manipulated into the flash position.

A power supply 60 is positioned within the housing 50. The power supply 60 is electrically coupled to the switch 58. The power supply 60 comprises at least one battery 62. A battery cover 64 is removably coupled to the back wall 52 of the housing 50. The power supply 60 is positioned beneath the battery cover 64.

In use, the fastener 24 corresponding to each of the light emitters 22 is extended through the associated hole 18 in the helmet 12. The bulb 38 corresponding to each of the light emitters 22 is coupled to the corresponding fastener 24. The housing 50 is coupled to the helmet 12 and the housing 50 is positioned at a selected point on the helmet 12. The helmet 12 is worn for head protection in the hazardous area. The switch 58 is manipulated to turn on the lighting unit 20. The lighting unit 20 emits light thereby enhancing visibility of the helmet 12. Thus, the lighting unit 20 enhances safety of a user.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A helmet safety system comprising:

a helmet being configured to be worn in a hazardous area, said helmet having a plurality of holes; and a lighting unit being removably coupled to said helmet wherein said lighting unit is configured to emit light thereby enhancing visibility of said helmet in the hazardous area, said lighting unit including a plurality of light emitters, each of said light emitters being removably coupled to said helmet, said light emitters being electrically coupled to each other to form a circuit, each of said light emitters comprising a fastener having a shaft extending away from a plate, said shaft having an outer surface, said outer surface being threaded, said shaft having a distal end with respect to said plate, said distal end being open, said plate having an opening extending therethrough, said fastener being substantially hollow, said shaft being inserted through an associated one of said holes in said helmet having said plate abutting said inner surface of said helmet.

2. The system according to claim 1, wherein said helmet has an inner surface and an outer surface, said helmet having a plurality of holes extending through said inner surface and said outer surface, said holes being spaced apart from each other and being distributed around said helmet.

3. The system according to claim 1, further comprising:

at least one conductor, said at least one conductor extending through said opening in said plate and said distal end of said shaft; and a contact being electrically coupled to said at least one conductor, said contact abutting said distal end of said shaft.

4. The system according to claim 3, further comprising a bulb threadably engaging said shaft when said shaft is extended through said selected opening such that each of said bulb and said fastener are removably coupled to said helmet, said bulb being electrically coupled to said contact when said bulb threadably engages said shaft.

5. The system according to claim 1, further comprising a control being removably coupled to said helmet wherein said control is configured to be manipulated, said control turning said lighting unit and on and off.

6. The system according to claim 5, wherein:

said lighting unit includes at least one conductor; and said control comprises a housing having a back wall and a front wall, said back wall being removably coupled to said helmet, said at least one conductor extending into said housing.

7. The system according to claim 6, further comprising:

a plurality of light emitters; and a switch being movably coupled to said front wall wherein said switch is configured to be manipulated, said switch being electrically coupled to said at least one conductor such that said switch turns said light emitters on and off.

8. The system according to claim 7, further comprising a power supply being positioned within said housing, said power supply being electrically coupled to said switch, said power supply comprising at least one battery.

9. A helmet safety system comprising:

a helmet being configured to be worn in a hazardous area, said helmet having an inner surface and an outer surface, said helmet having a plurality of holes extending through said inner surface and said outer surface, said holes being spaced apart from each other and being distributed around said helmet; and a lighting unit being removably coupled to said helmet wherein said lighting unit is configured to emit light thereby enhancing visibility of said helmet in the hazardous area, said lighting unit comprising:

a plurality of light emitters, each of said light emitters being removably coupled to said helmet, said light emitters being electrically coupled to each other to form a circuit, each of said light emitters comprising:

a fastener having a shaft extending away from a plate, said shaft having an outer surface, said outer surface being threaded, said shaft having a distal end with respect to said plate, said distal end being open, said plate having an opening extending therethrough, said fastener being substantially hollow, said shaft being inserted through an associated one of said holes in said helmet having said plate abutting said inner surface of said helmet, at least one conductor, said at least one conductor extending through said opening in said plate and said distal end of said shaft, a contact being electrically coupled to said at least one conductor, said contact abutting said distal end of said shaft, and a bulb threadably engaging said shaft when said shaft is extended through said selected opening such that each of said bulb and said fastener are removably coupled to said helmet, said bulb being electrically coupled to said contact when said bulb threadably engages said shaft; and a control being removably coupled to said helmet wherein said control is configured to be manipulated, said control turning said lighting unit and on and off, said control comprising:

a housing having a back wall and a front wall, said back wall being removably coupled to said helmet, said at least one conductor extending into said housing, a switch being movably coupled to said front wall wherein said switch is configured to be manipulated, said switch being electrically coupled to said at least one conductor such that said switch turns said light emitters on and off, and a power supply being positioned within said housing, said power supply being electrically coupled to said switch, said power supply comprising at least one battery.

* * * * *